US007401600B1

(12) United States Patent
Labus et al.

(10) Patent No.: US 7,401,600 B1
(45) Date of Patent: Jul. 22, 2008

(54) PURGE FLOW CONTROL TO REDUCE AIR/FUEL RATIO IMBALANCE

(75) Inventors: Gregory E. Labus, West Chester, PA (US); Jerry W. Kortge, Clarkston, MI (US); William R. Cadman, Fenton, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 4 days.

(21) Appl. No.: 11/668,868

(22) Filed: Jan. 30, 2007

(51) Int. Cl.
*F02M 33/02* (2006.01)

(52) U.S. Cl. ..... 123/520

(58) Field of Classification Search ..... 123/520
See application file for complete search history.

(56) References Cited

U.S. PATENT DOCUMENTS 4,766,921 A * 8/1988 Williams ..... 137/1
5,351,193 A * 9/1994 Poirier et al. ..... 701/99
5,425,349 A * 6/1995 Nagaishi et al. ..... 123/674
5,429,098 A 7/1995 Tomisawa ..... 123/520
5,606,955 A * 3/1997 Yuda ..... 123/520
6,098,644 A * 8/2000 Ichinose ..... 137/1
6,102,364 A * 8/2000 Busato ..... 251/129.05
6,310,754 B1 * 10/2001 Busato ..... 361/187
6,578,564 B2 * 6/2003 Bagnasco ..... 123/698
6,722,347 B2 * 4/2004 Sanchez et al. ..... 123/520
6,729,312 B2 * 5/2004 Furushou ..... 123/520
6,830,039 B2 * 12/2004 Duty et al. ..... 123/520
7,182,072 B1 * 2/2007 Clemens ..... 123/520

* cited by examiner

*Primary Examiner*—Thomas N Moulis

(57) ABSTRACT

A fuel control system that regulates a purge flow from a fueling system to an engine includes a sensor that monitors an engine speed and a first module that determines a PWM frequency of a purge valve based on the engine speed. The PWM frequency includes a first period that is based on a second period that corresponds to two engine cycles. A second module regulates the purge valve based on the PWM frequency during engine operation.

22 Claims, 4 Drawing Sheets

PURGE FLOW CONTROL TO REDUCE AIR/FUEL RATIO IMBALANCE

FIELD OF THE INVENTION

The present invention relates to internal combustion engines, and more particularly to a purge flow control system to reduce air-to-fuel ratio imbalance.

BACKGROUND OF THE INVENTION

Internal combustion engines combust an air and fuel mixture within cylinders to generate drive torque. More specifically, air is drawn into the engine through a throttle and fuel is provided to the engine from a fuel system. The air and fuel are mixed at a desired air-to-fuel (A/F) ratio and is combusted within a cylinder to rotatably drive a crankshaft.

Some fuel systems include a fuel vapor purge valve to provide an evaporative emissions control. The purge valve is selectively actuated to deliver vapor fuel from the fuel system to be combusted within the engine. Many current production implementations of purge valve control use a fixed pulse-width modulated (PWM) frequency (e.g., 16 Hz).

Problems occur if the engine cylinder firing frequency becomes synchronized with the PWM purge frequency. For example, at an engine speed of 1920 RPM, one complete firing cycle (i.e., all cylinders fired) includes a period of 62.5 ms. For a PWM frequency of 16 Hertz, the fuel purge period is also 62.5 ms. Therefore, at 1920 RPM, the purge frequency is synchronized with the firing frequency of the engine cylinders. As a result, the purge fuel flow is delivered to the same cylinder or is possibly consistently split between a few cylinders. An A/F ratio imbalance is generated between the cylinders receiving the purge fuel flow and those not receiving the purge fuel flow, which can be detrimental to emissions, engine smoothness and driveability.

SUMMARY OF THE INVENTION

Accordingly, the present invention provides a fuel control system that regulates a purge flow from a fueling system to an engine. The fuel control system includes a sensor that monitors an engine speed and a first module that determines a PWM frequency of a purge valve based on the engine speed. The PWM frequency includes a first period that is based on a second period that corresponds to two engine cycles. A second module regulates the purge valve based on the PWM frequency during engine operation.

In one feature, the first period is greater than the second period by a single cylinder firing period.

In another feature, the first period is less than the second period by a single cylinder firing period.

In another feature, the first period is selected from a range defined between a minimum period and a maximum period.

In still another feature, the period is continuously variable.

In yet other features, the first period is variable between discrete values. The discrete values differ from one another by a specific increment.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
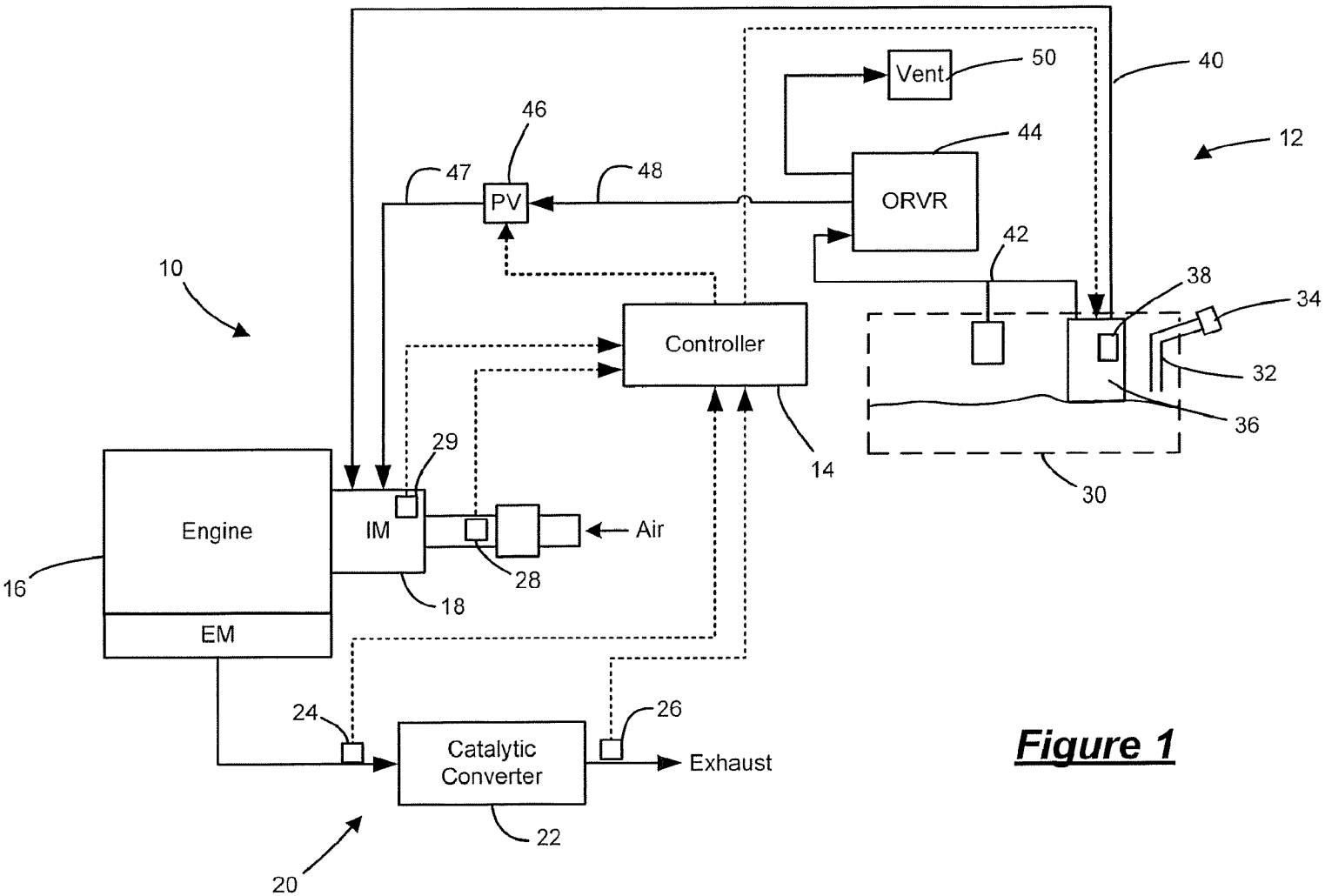
FIG. 1 is a functional block diagram of an exemplary vehicle including an exemplary fuel system that is regulated based on the purge flow control of the present invention.

The following description of the preferred embodiment is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality.

Referring now to FIG. 1, an engine system 10 and a fuel system 12 are shown. One or more control modules 14 communicate with the engine and fuel systems 10, 12. The fuel system 12 selectively supplies liquid and/or vapor fuel to the engine system 10, as will be described in further detail below.

The engine system 10 includes an engine 16, an intake manifold 18, and an exhaust 20. Air and fuel are drawn into the engine 16 and are combusted therein. Exhaust gases flow through the exhaust 20 and are treated in a catalytic converter 22. First and second $O_2$ sensors 24 and 26 communicate with the control module 14 and provide exhaust A/F ratio signals to the control module 14. A mass air flow (MAF) sensor 28 is located within an air inlet and provides a mass air flow (MAF) signal based on the mass of air flowing into the intake manifold 18. The control module 14 uses the MAF signal to determine the A/F ratio supplied to the engine 16. An intake manifold temperature sensor 29 generates an intake air temperature signal that is sent to the controller 14.

The fuel system 12 includes a fuel tank 30 that contains liquid fuel and fuel vapors. A fuel inlet 32 extends from the fuel tank 30 to allow fuel filling. A fuel cap 34 closes the fuel inlet 32 and may include a bleed hole (not shown). A modular reservoir assembly (MRA) 36 is disposed within the fuel tank 30 and includes a fuel pump 38. The MRA 36 includes a liquid fuel line 40 and a vapor fuel line 42. The fuel pump 38 pumps liquid fuel through the liquid fuel line 40 to the engine 16. Vapor fuel flows through the vapor fuel line 42 into an on-board refueling vapor recovery (ORVR) canister 44. A vapor fuel line 47 connects a purge solenoid valve 46 to the intake manifold 18 and a vapor fuel line 48 connects the ORVR canister 44 and the purge solenoid valve 46. The control module 14 modulates the purge solenoid valve 46 in accordance with the purge flow control of the present invention to selectively enable vapor fuel flow to the engine 16. The control module 14 modulates a canister vent solenoid valve 50 to selectively enable air flow from atmosphere into the ORVR canister 44.

The purge flow control of the present invention prevents synchronization of a pulse-width modulated (PWM) frequency ($f_{PWM}$) of the purge solenoid valve 46 and cylinder firing frequency ($f_{CYL}$) by adjusting $f_{PWM}$ based on engine RPM. More specifically, $f_{PWM}$ is commanded to a value that is not synchronized with $f_{CYL}$, which is determined based on engine RPM. The PWM frequency includes a period ($T_{PWM}$) that is longer or shorter than a period of two engine cycles ($T_{ENG}$) by at least one cylinder firing period ($T_{CYL}$). $T_{PWM}$ overlaps or falls short by one cylinder relative to $T_{ENG}$. In this manner, $f_{PWM}$ synchronizes with a different cylinder (e.g., the next or previous cylinder in the firing order) each time the purge period starts again, causing the purge off-to-on transition to be evenly distributed over all cylinders.

$T_{ENG}$ is calculated in accordance with the following equation:

$$T_{ENG} = \left(\frac{1}{RPM}\right)\left(\frac{60s}{1\min}\right)\left(\frac{2revs}{allcyls}\right)$$

The term $$\frac{2revs}{allcyls}$$

indicates that all of the cylinders have fired after two engine revolutions. $T_{PWM}$ is calculated based on $T_{ENG}$ in accordance with the following equation:

$$T_{PWM} = \left(\frac{N \pm 1}{N}\right)T_{ENG}$$

where N is the number of cylinders. $f_{PWM}$ is determined based on engine RPM in accordance with the following relationship:

$$f_{PWM} = \left(\frac{N}{N \pm 1}\right)\left(\frac{RPM}{120}\right)$$

Figure 2:
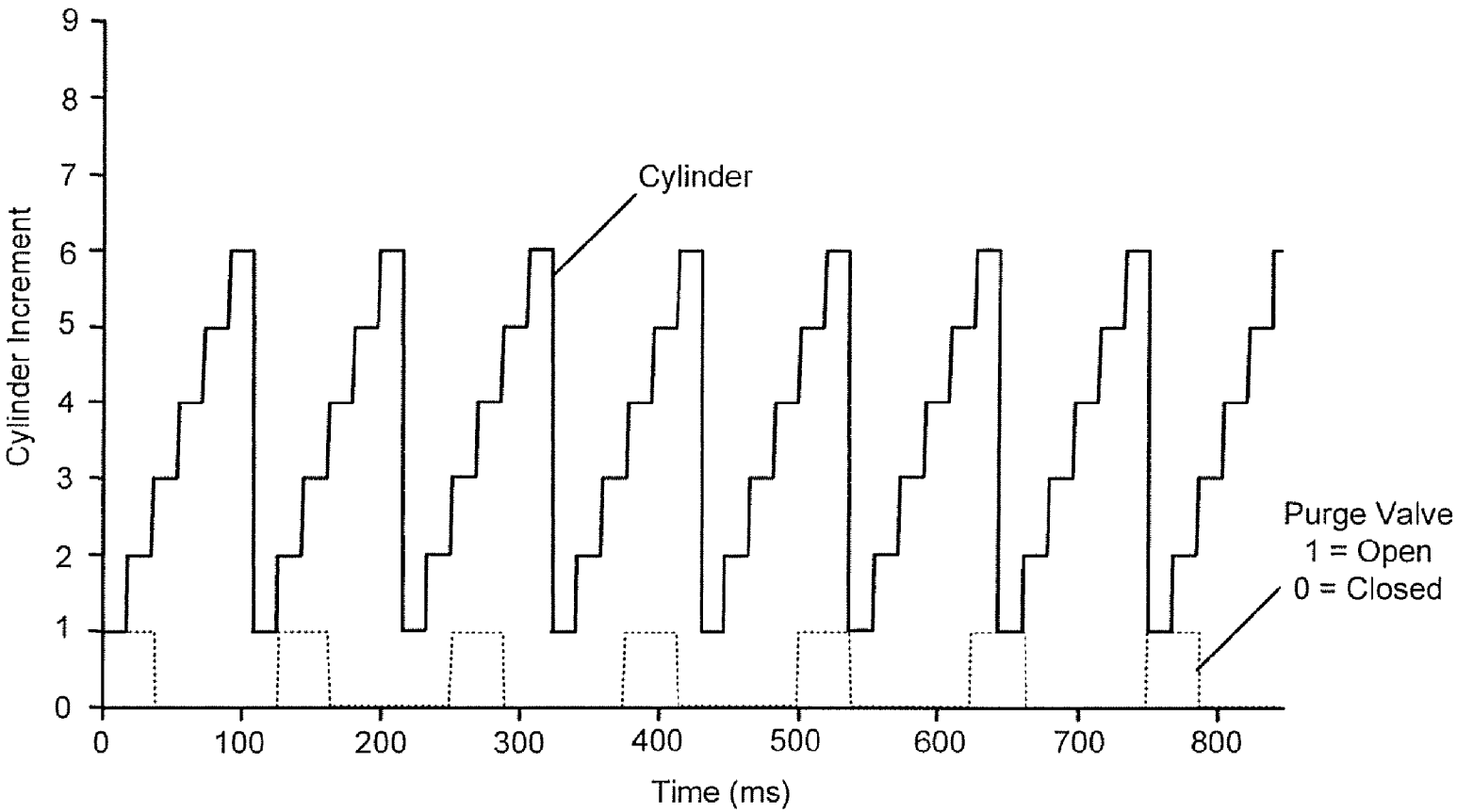
FIG. 2 is a graph illustrating exemplary cylinder firing and purge valve traces in accordance with the purge flow control of the present invention.

Referring now to FIG. 2, the graph illustrates cylinder increment and purge frequency traces for a 6-cylinder engine running at 1120 RPM with a PWM frequency of 8 Hz. $T_{ENG}$ is approximately 107.17 ms and $T_{PWM}$ is approximately 125 ms. The firing period of a single cylinder is approximately 8.93 ms. The ratio of $T_{PWM}$ to $T_{ENG}$ is 7/6, which is a one cylinder firing period overlap for a 6-cylinder engine. Alternatively, $T_{PWM}$ can be selected to be one cylinder firing period behind, whereby the ratio is 5/6.

It is anticipated that $f_{PWM}$ can vary between a range defined by maximum and minimum frequencies (e.g., 4 Hz and 32 Hz, respectively). Roll-over protection is implemented in cases where $f_{PWM}$ would fall below or exceed the minimum and maximum frequencies, respectively. For example, $f_{PWM}$ is equal to 32 Hz at approximately 3215 RPM for the exemplary 6-cylinder engine. If the engine RPM increases, $f_{PWM}$ would exceed the exemplary maximum frequency (e.g., 32 Hz). In this case, $f_{PWM}$ would roll-over to the minimum frequency (e.g., 4 Hz) and increase from there with a corresponding increase in engine RPM. Similarly, if the engine RPM is just above 3215 RPM, such that $f_{PWM}$ is at or near the minimum frequency (e.g., 4 Hz), and the engine RPM decreases to be at or below 3215 RPM, $f_{PWM}$ would roll-over in the opposite direction to the maximum frequency (e.g., 32 Hz).

In order to implement the purge flow control of the present invention in cheaper, less complex control modules, it is anticipated that the $f_{PWM}$ can be adjusted in increments, as opposed to continuous adjustment. More specifically, $f_{PWM}$ can be adjusted between discrete frequencies at specific frequency intervals based on engine RPM. For example, $f_{PWM}$ can be adjusted within a range defined between minimum and maximum frequencies (e.g., 4 and 32 Hz, respectively) at 4 Hz increments. The control module monitors engine RPM and determines $f_{PWM}$ from a pre-stored, pre-defined look-up table. It is anticipated that the roll-over protection described in detail above can also be implemented in this case.

In the case of incremental adjustment of $f_{PWM}$ based on engine RPM, a hysteresis feature can be implemented. If the engine RPM is hovering at a break-point between two discrete purge frequencies, $f_{PWM}$ would switch back and forth between values on each side of the break-point. The hysteresis feature prevents transition of $f_{PWM}$ until the engine RPM is within a new region for a threshold time ($t_{THR}$) (e.g., 2 seconds). For example, if the engine RPM is within a first region where $f_{PWM}$ is 16 Hz and then varies to be within a second region where $f_{PWM}$ should be 20 Hz, the purge flow control does not actually change $f_{PWM}$ to 20 Hz until the engine RPM has been within the second region for $t_{THR}$.

Figure 3:
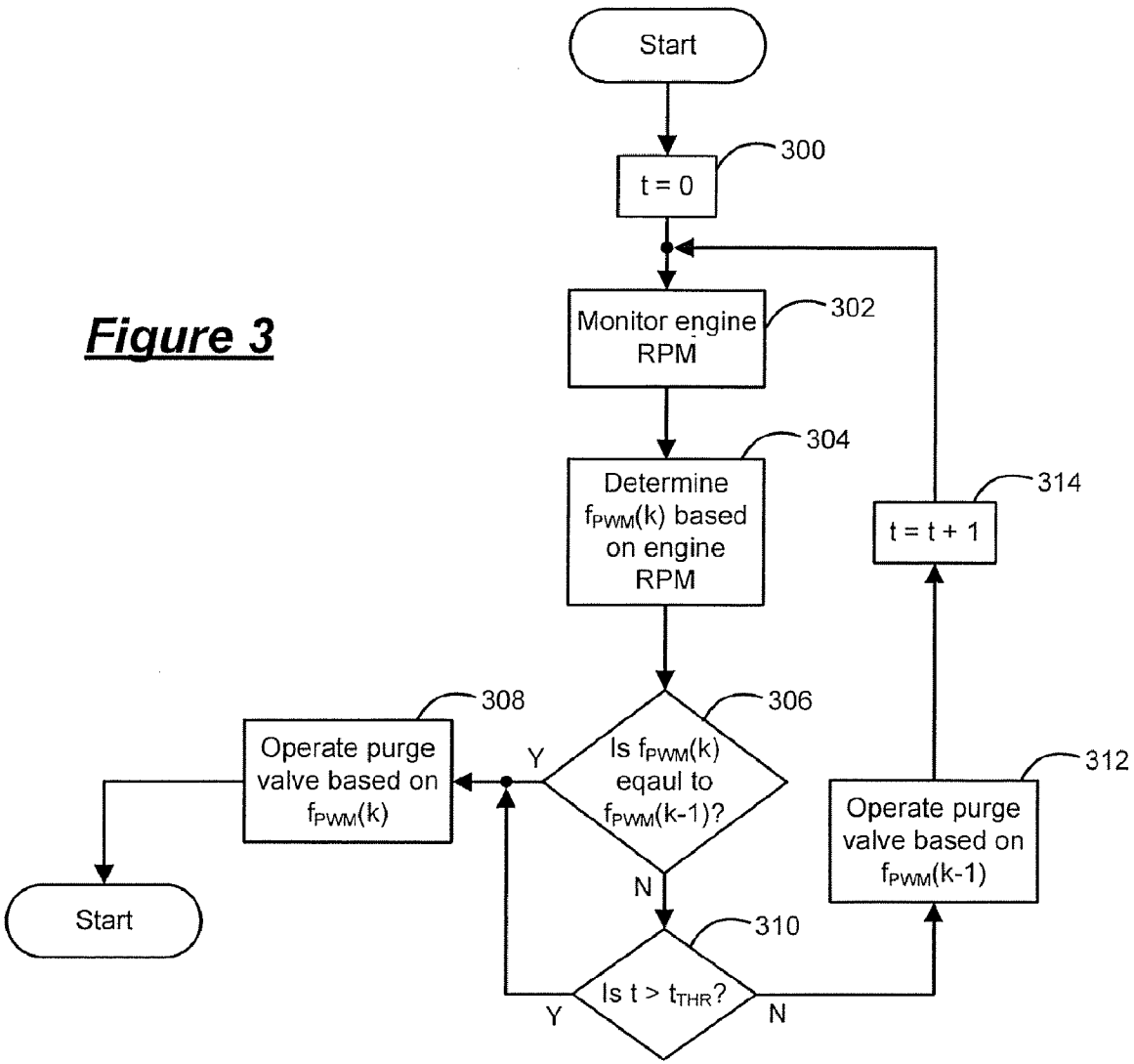
FIG. 3 is a flowchart illustrating exemplary steps executed by the purge flow control of the present invention.

Referring now to FIG. 3, exemplary steps executed by the purge flow control will be discussed in detail. In step 300, control sets a timer (t) equal to zero. In step 302, control monitors engine RPM. Control determines a current $f_{PWM}$ ($f_{PWM}(k)$) based on engine RPM in step 304. More particularly, control determines $f_{PWM}(k)$, as described above, whereby $T_{PWM}$ varies from $T_{ENG}$ by $T_{CYL}$.

In step 306, control determines whether $f_{PWM}(k)$ is equal to the previously determined $f_{PWM}$ ($f_{PWM}(k-1)$), at which the purge valve is presently being operated. If $f_{PWM}(k)$ is equal to $f_{PWM}(k-1)$, control operates the purge valve based on $f_{PWM}(k)$ in step 308 and control ends. If $f_{PWM}(k)$ is not equal to $f_{PWM}(k-1)$, control determines whether t is greater than $t_{THR}$ in step 310. If t is greater than $t_{THR}$, control operates the purge valve based on $f_{PWM}(k)$ in step 308 and control ends. If t is not greater than $t_{THR}$, control operates the purge valve based on $f_{PWM}(k-1)$ in step 312. In step 314, control increments t and loops back to step 302.

Figure 4:
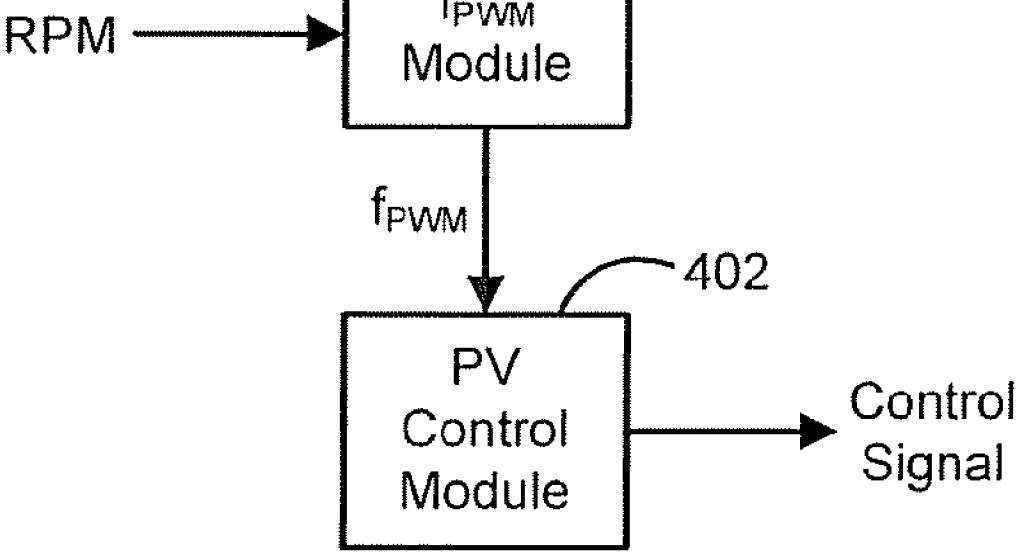
FIG. 4 is a functional block diagram of exemplary modules that execute the purge flow control of the present invention.

Referring now to FIG. 4, exemplary modules that execute the purge flow control of the present invention will be discussed in detail. The exemplary modules include an $f_{PWM}$ module 400 and a purge valve (PV) control module 402. The $f_{PWM}$ module 400 determines $f_{PWM}$ based on engine RPM and the PV control module 402 generates a control signal to regulate operation of the purge valve based on $f_{PWM}$.

The purge flow control of the present invention improves evaporative emissions control systems by reducing the A/F ratio imbalance across the cylinders that results from the introduction of purge fuel flow. By reducing the A/F imbalance, the following benefits are realized: the reduction of engine-out exhaust emissions, improved engine smoothness in areas including idle quality and driveability, and improvements in fuel economy.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A fuel control system that regulates a purge flow from a fueling system to an engine, comprising:

a sensor that monitors an engine speed;

a first module that determines a PWM frequency of a purge valve based on said engine speed, wherein said PWM frequency includes a first period that is based on a second period that corresponds to two engine cycles; and a second module that regulate said purge valve based on said PWM frequency during engine operation.

2. The fuel control system of claim 1 wherein said first period is greater than said second period by a single cylinder firing period.

3. The fuel control system of claim 1 wherein said first period is less than said second period by a single cylinder firing period.

4. The fuel control system of claim 1 wherein said first period is selected from a range defined between a minimum period and a maximum period.

5. The fuel control system of claim 1 wherein said first period is continuously variable.

6. The fuel control system of claim 1 wherein said first period is variable between discrete values.

7. The fuel control system of claim 6 wherein said discrete values differ from one another by a specific increment.

8. A method of regulating a purge flow valve of a fuel system that provides fuel to an engine, comprising:

monitoring an engine speed;

determining a PWM frequency of said purge valve based on said engine speed, wherein said PWM frequency includes a first period that is based on a second period that corresponds to two engine cycles; and regulating said purge valve based on said PWM frequency during engine operation.

9. The method of claim 8 wherein said first period is greater than said second period by a single cylinder firing period.

10. The method of claim 9 wherein said first period is less than said second period by a single cylinder firing period.

11. The method of claim 9 wherein said first period is selected from a range defined between a minimum period and a maximum period.

12. The method of claim 9 wherein said first period is continuously variable.

13. The method of claim 9 wherein said first period is variable between discrete values.

14. The method of claim 13 wherein said discrete values differ from one another by a specific increment.

15. A method of regulating operation of an internal combustion engine, comprising:

monitoring an engine speed;

determining a PWM frequency for a purge valve of a fuel system based on said engine speed, wherein said PWM frequency includes a first period that is based on a second period that corresponds to two engine cycles;

fueling a cylinder of said engine; and regulating said purge valve based on said PWM frequency during engine operation to periodically provide additional fuel to said cylinder.

16. The method of claim 15 wherein said first period is greater than said second period by a single cylinder firing period.

17. The method of claim 15 wherein said first period is less than said second period by a single cylinder firing period.

18. The method of claim 15 wherein said first period is selected from a range defined between a minimum period and a maximum period.

19. The method of claim 15 wherein said first period is continuously variable.

20. The method of claim 15 wherein said first period is variable between discrete values.

21. The method of claim 20 wherein said discrete values differ from one another by a specific increment.

22. The method of claim 15 wherein said PWM frequency transitions from a first value that is associated with a first engine RPM region to a second value that is associated with a second engine RPM region only after said engine RPM remains in said second engine RPM region for a threshold time.

* * * * *